US010731833B2

(12) United States Patent
Tsai

(10) Patent No.: US 10,731,833 B2
(45) Date of Patent: Aug. 4, 2020

(54) ILLUMINATION DEVICE

(71) Applicant: Qisda Corporation, Taoyuan (TW)

(72) Inventor: Chang-Yu Tsai, Taipei (TW)

(73) Assignee: Qisda Corporation, Taoyuan (TW)

( * ) Notice: Subject to any disclaimer, the term of this patent is extended or adjusted under 35 U.S.C. 154(b) by 0 days.

(21) Appl. No.: 16/529,914

(22) Filed: Aug. 2, 2019

(65) Prior Publication Data

US 2020/0141564 A1 May 7, 2020

(30) Foreign Application Priority Data

Nov. 6, 2018 (CN) ..... 2018 1 1311034

(51) Int. Cl.

| | |
|---|---|
| ***F21V 21/088*** | (2006.01) |
| ***F21V 5/04*** | (2006.01) |
| ***F21V 7/00*** | (2006.01) |
| ***F21V 21/14*** | (2006.01) |
| ***F21V 23/04*** | (2006.01) |

(52) U.S. Cl.

CPC ..... *F21V 21/088* (2013.01); *F21V 5/04* (2013.01); *F21V 7/0091* (2013.01); *F21V 21/14* (2013.01); *F21V 23/0464* (2013.01)

(58) Field of Classification Search

CPC ..... F21V 21/088; F21V 21/14; F21V 7/091; F21V 5/04; F21V 23/0464; F21V 33/0052; F21V 23/0442; F21V 7/0091; F21W 2131/30

See application file for complete search history.

(56) References Cited

U.S. PATENT DOCUMENTS

| | | | | |
|---|---|---|---|---|
| 6,203,175 | B1 * | 3/2001 | Basacchi | F21S 9/02 362/287 |
| 9,494,844 | B2 * | 11/2016 | Fisher | G03B 15/03 |
| 10,488,035 | B1 * | 11/2019 | Yang | F21V 33/0052 |
| 2005/0007778 | A1 * | 1/2005 | Lin | F21V 21/32 362/249.07 |
| 2017/0219915 | A1 * | 8/2017 | Mueller | G03B 17/54 |
| 2019/0353343 | A1 * | 11/2019 | Pan | F21V 33/0052 |

FOREIGN PATENT DOCUMENTS

| | | | | |
|---|---|---|---|---|
| CN | 107631190 A | * | 1/2018 | F21S 2/00 |

OTHER PUBLICATIONS

English Translation of Chinese Patent CN 107631190A, Jan. 2018, Inventor Changyu Cai (Year: 2018).*

* cited by examiner

*Primary Examiner* — Peggy A Neils

(57) ABSTRACT

The present invention discloses an illumination device for an electronic device. The electronic device has a screen and a host, wherein a first lateral side of the screen is pivotally connected to the host having a keyboard surface. The illumination device includes a lampshade, a clamping portion and a light source. The clamping portion is connected to the lampshade and clamps the illumination device on a second lateral side of the screen, wherein the second lateral side is an opposite side of the first lateral side. The light source is disposed in the lampshade and provides an illuminating light, wherein a fixed angle is formed between an optical axis of the illuminating light and a keyboard surface of the host.

15 Claims, 4 Drawing Sheets

ILLUMINATION DEVICE

This application claims the benefit of People's Republic of China application Serial No. 201811311034.7, filed Nov. 6, 2018, the subject matter of which is incorporated herein by reference.

BACKGROUND OF THE INVENTION

Field of the Invention

The invention relates in general to an illumination device for an electronic device, and more particularly to an illumination device with a clamping portion.

Description of the Related Art

Currently, the illumination device (such as the desk lamp or the clip-on lamp) used in conjunction with the notebook computer may easily irradiate a light onto the display screen or the keyboard of the electronic device and generate a dazzling reflective light, causing the user's eyes uncomfortable. Even though the user can manually adjust the angle of the illumination device, it takes time and effort, and it is not easy to find a suitable angle or position of the illumination device. Therefore, it has become a prominent task for the industries to provide a new illumination device to resolve the above problems.

SUMMARY OF THE INVENTION

The invention is directed to an illumination device for an electronic device and capable of resolving the problems encountered in the prior art.

According to one embodiment of the present invention, an illumination device for an electronic device is provided. The electronic device has a screen and a host, wherein a first lateral side of the screen is pivotally connected to the host having a keyboard surface. The illumination device includes a lampshade, a clamping portion and a light source. The clamping portion is connected to the lampshade and clamps the illumination device on a second lateral side of the screen, wherein the second lateral side is an opposite side of the first lateral side. The light source is disposed in the lampshade and provides an illuminating light having an optical axis, wherein a fixed angle is formed between the optical axis of the illuminating light and the keyboard surface. Thus, the reflective light provided by the illumination device will not dazzle users' eyes and the reflective light reflected from the display screen or the keyboard will not directly enter users' eyes and make them feel uncomfortable. The illumination device of the present invention improves the user's experience of use.

The above and other aspects of the invention will become better understood with regard to the following detailed description of the preferred but non-limiting embodiment (s). The following description is made with reference to the accompanying drawings.

DETAILED DESCRIPTION OF THE INVENTION

The structure and operation principles of the illumination device of the present invention are disclosed below with accompanying drawings.

Figure 1A:
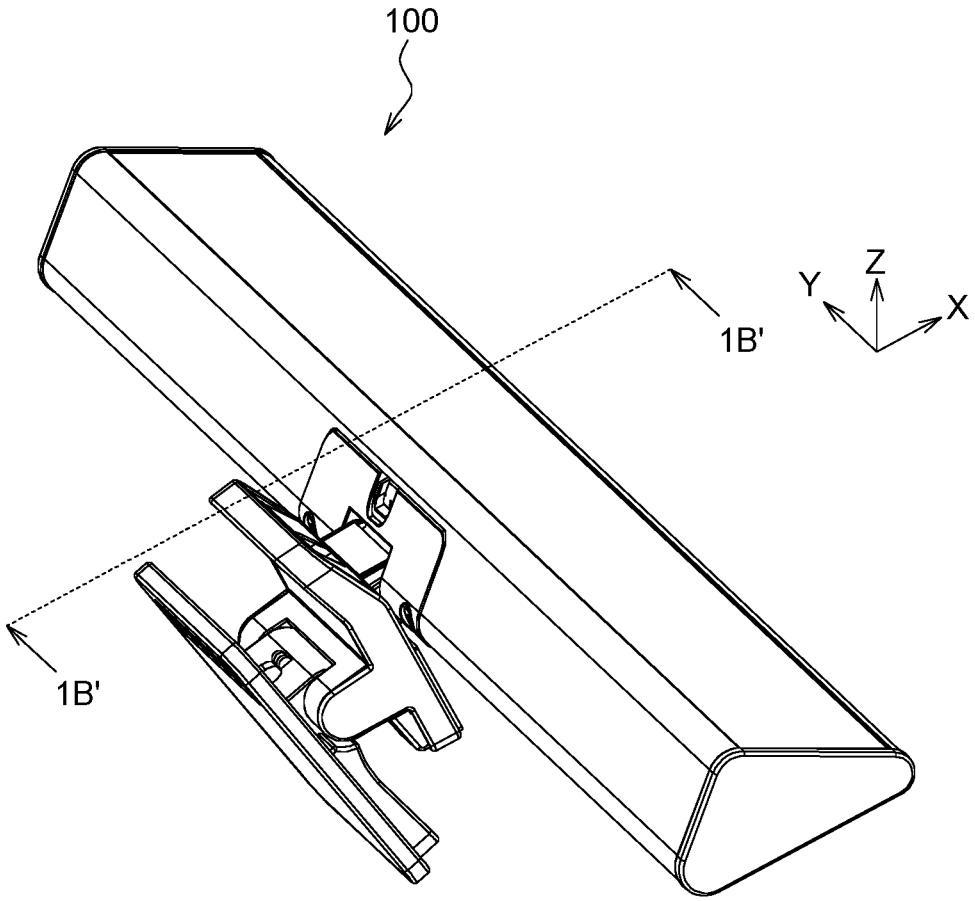
FIG. 1A is a schematic diagram of an illumination device 100 according to an embodiment of the present invention.
Figure 1B:
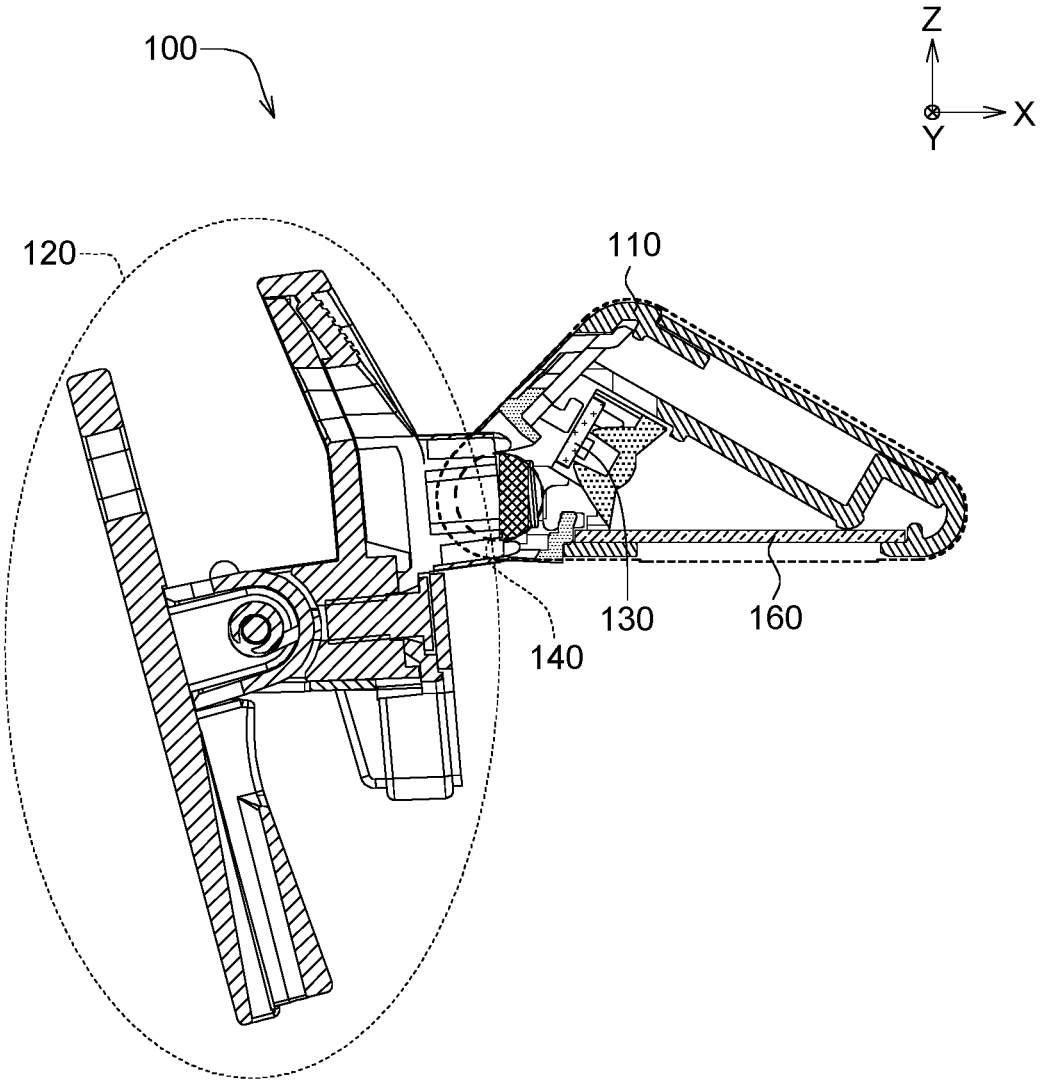
FIG. 1B is a cross-sectional view of the illumination device 100 of FIG. 1A along a cross-sectional line 1B-1B'.
Figure 2:
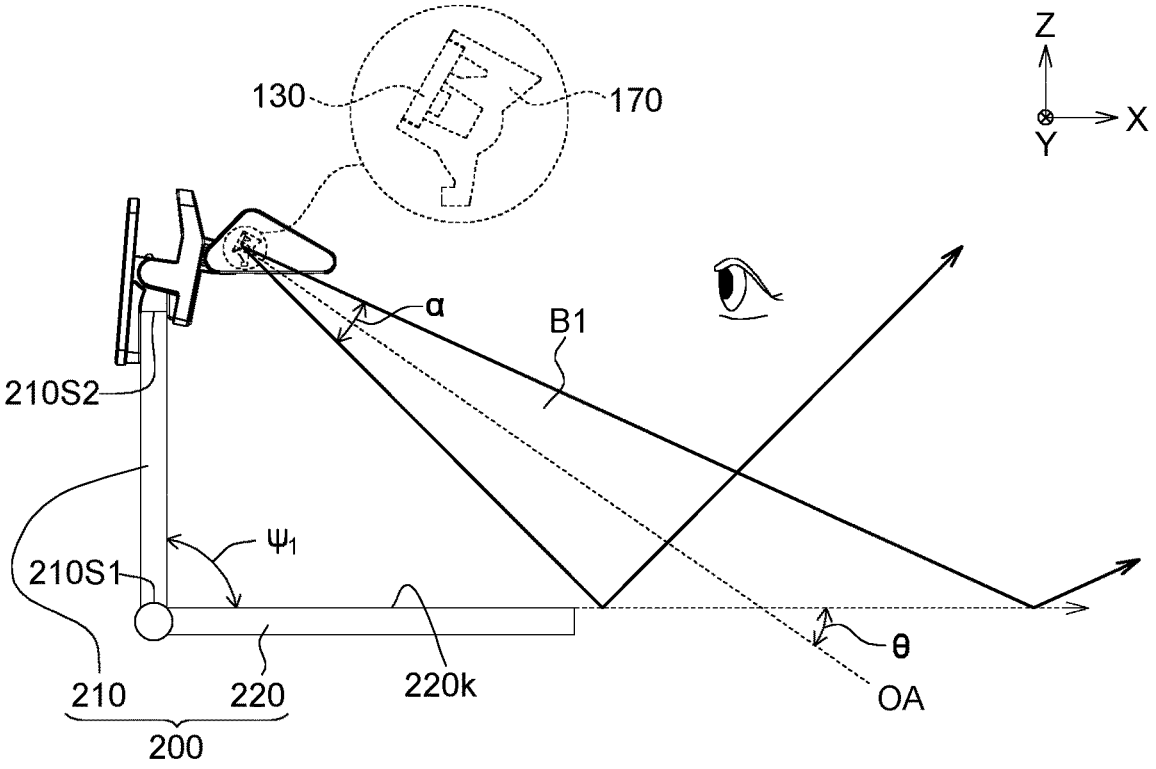
FIG. 2 is a side view of the illumination device 100 of FIG. 1A disposed on an electronic device 200.

Refer to FIG. 1A, 1B and FIG. 2. FIG. 1A is a schematic diagram of an illumination device 100 according to an embodiment of the present invention. FIG. 1B is a cross-sectional view of the illumination device 100 of FIG. 1A along a cross-sectional line 1B-1B'. FIG. 2 is a side view of the illumination device 100 of FIG. 1A disposed on an electronic device 200. As illustrated in FIG. 2, the illumination device 100 can be detachably disposed on the electronic device 200. The electronic device 200 has a screen 210 and a host 220, wherein a first lateral side 210*s*1 of the screen 210 is pivotally connected to the host 220. The host 220 has a flat keyboard surface 220*k*. According to some embodiments, the electronic device 200 can be realized by a notebook computer, and an adjustable angle φ1 is formed between the screen 210 and the keyboard surface 220*k*.

Continue to refer to FIG. 1B and FIG. 2. The illumination device 100 may include a lampshade 110, a clamping portion 120, a light source 130, a rotation portion 140 and a light-passing plate 160. The clamping portion 120 is connected to the lampshade 110 and clamps the illumination device 100 on the second lateral side 210*s*2 of the screen 210, wherein the first lateral side 210*s*1 and the second lateral side 210*s*2 of the screen 210 are opposite to each other, that is, the second lateral side 210*s*2 is an opposite side of the first lateral side 210*s*1. The light source 130 is disposed in the lampshade 110 and provides an illuminating light B1 having an optical axis OA. A fixed angle θ can be formed between the optical axis OA of the illuminating light B1 and the keyboard surface 220*k*, wherein the fixed angle θ is between 25°~35°. Through the said optical design, the illuminating light B1 emitted from the light source 130 mainly irradiates on the regions outside the keyboard surface 220*k*, and only a small portion of light emitted from the light source 130 directly irradiates on the keyboard surface 220*k* and generates a non-dazzling reflective light. Since the light reflected from the keyboard surface 220*k* or the screen will not blind the user's eyes, the user can have a comfortable experience of use.

The experimental results obtained in some embodiments show that the most suitable size of the fixed angle θ is about 30°.

As illustrated in FIG. 2, the illuminating light B1 emitted from the light source 130 has a beam angle α. In an embodiment, the illumination device 100 may further include an optical lens 170 disposed in the lampshade 110 and changing the size of the beam angle α. According to some embodiments, the optical lens 170 may, for example, change the beam angle α to be between 20°~30° to focus the illumination within a smaller region, such that accent lighting can be provided and light dispersion can be avoided. According to some embodiments, the optical lens 170 can be realized by such as a total internal reflection (TIR) lens with strip shape.

As illustrated in FIG. 1B, the rotation portion 140 connects the lampshade 110 and the clamping portion 120. That is, the lampshade 110 can be coupled to the clamping portion 120 through the rotation portion 140, but the invention is not limited thereto. In an embodiment, the lampshade 110 can be directly connected to the clamping portion 120.

Figure 3:
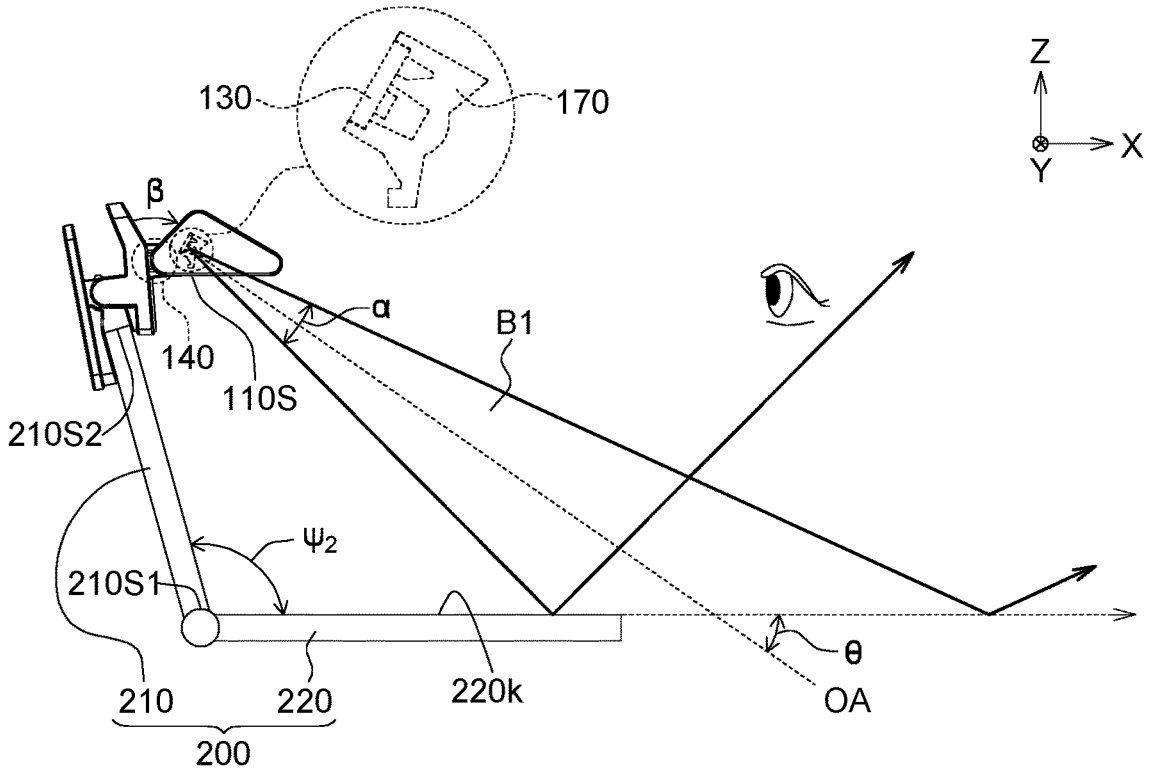
FIG. 3 is a side view of the illumination device 100 of FIG. 2 adjustable with respect to the screen 210.

Referring to FIG. 3, a side view of the illumination device 100 of FIG. 2 adjustable with respect to the screen 210 is shown. As illustrated in FIG. 3, when the angle between the screen 210 and the host 220 changes, for example, the angle between the screen 210 and the keyboard surface 220*k* changes to angle φ2 from angle φ1 (φ2 is, for example, larger than φ1), the rotation portion 140 may allow the lampshade 110 and the clamping portion 120 to rotate with respect to each other by an angle β to adjust the angle between the lampshade 110 and the clamping portion 120. Thus, when the illuminating surface 110*s* of the lampshade 110 is substantially parallel to the keyboard surface 220*k*, the fixed angle θ between the optical axis OA of the illuminating light B1 emitted from the light source 130 and the keyboard surface 220*k* can maintain unchanged. When the angle φ2 is smaller than the angle φ1, the lampshade 110 and the clamping portion 120 rotate with respect to each other in an inverse direction.

According to some embodiments, the angle φ may change between 90°~120°, the rotation portion 140 allows the angle between the lampshade 110 and the clamping portion 120 to change by 0°~52°, but the invention is not limited thereto.

According to some embodiments, when the illuminating surface 110*s* of the lampshade 110 is substantially parallel to the keyboard surface 220*k*, the illuminating light B1 emitted from the light source 130 mainly irradiates on a region outside the keyboard surface 220*k* (the region is such as the user's work region) to focus the illuminating light on the user to meet the user's illumination requirement.

Besides, the illumination device 100 may further include an inclination sensor (not illustrated), and the inclination sensor can be disposed in the lampshade 110. The inclination sensor senses whether the illuminating surface 110*s* of the lampshade 110 is substantially parallel to the keyboard surface 220*k*. According to some embodiments, when the inclination sensor senses that the illuminating surface 110*s* of the lampshade 110 is substantially parallel to the keyboard surface 220*k*, an indicator lamp (not illustrated) disposed in the lampshade 100 is turned on or flashes for several times; or, when the illuminating surface 110*s* is substantially parallel to the keyboard surface 220*k*, the light source 130 itself flashes for several times to remind the user that the illumination device 100 is at an optimal state of use. That is, the reflective light generated by the illumination device 100 is non-dazzling, and will not directly enter the user's eyes and make them feel uncomfortable. The illumination device of the present invention provides the user with optimal experience of use.

In an embodiment, the inclination sensor can be realized by such as a leveling instrument, specifically, a bubble leveling instrument.

Figure 4:
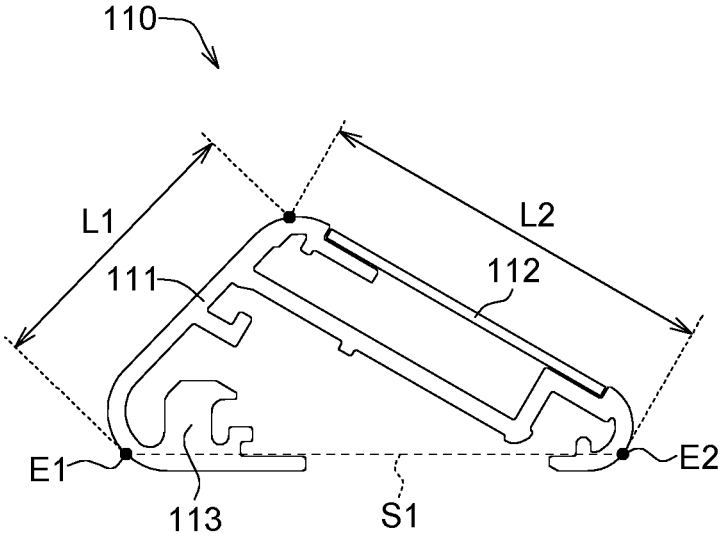
FIG. 4 is a side view of a lampshade 110 of the illumination device 100 of FIG. 1B.

Referring to FIG. 4, a side view of a lampshade 110 of the illumination device 100 of FIG. 1B is shown. As illustrated in FIG. 4, the lampshade 110 has a first side portion 111, a second side portion 112 and a bottom portion 113. According to some embodiments, the light source 130 of FIG. 1B is disposed on the first side portion 111 of the lampshade 110, and the light-passing plate 160 of FIG. 1B is disposed between the bottom portion 113 and the second side portion 112 of the lampshade 110 and protects the light source 130, but the invention is not limited thereto. In an embodiment, the illumination device 100 can omit the light-passing plate 160.

As illustrated in FIG. 4, the length L2 of the second side portion 112 is larger than or equivalent to the length L1 of the first side portion 111. Through such design, the region irradiated by the illuminating light B1 emitted from the light source 130 can be restricted with the second side portion 112, such that the illuminating light B1 emitted from the light source 130 will not freely enter the user's eyes and cause damage. Furthermore, a connection line S1 connecting an edge E1 of the first side portion 111 and an edge E2 of the second side portion 112 is substantially parallel to the keyboard surface 220*k*, such that the fixed angle θ between the optical axis OA of the illuminating light B1 emitted from the light source 130 and the keyboard surface 220*k* can be maintained. The illuminating surface 110*s* of FIG. 3 is parallel to the connection line S1 connecting the edge E1 of the first side portion 111 and the edge E2 of the second side portion 112.

Figure 5:
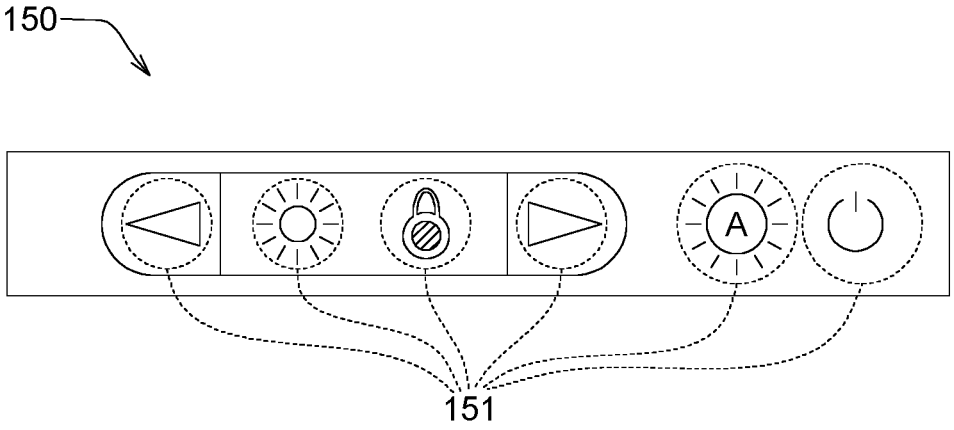
FIG. 5 is a schematic diagram of a user interface 150 of an illumination device 100 according to another embodiment of the present invention.

Referring to FIG. 5, a schematic diagram of a user interface 150 of an illumination device 100 according to another embodiment of the present invention is shown. As illustrated in FIG. 5, the illumination device 100 may further include an user interface 150 disposed on the lampshade 110 and providing one or more than one function pattern 151. Through the function pattern 151, the user can trigger various functions of the illumination device 100, wherein the functions include at least one of brightness adjustment, color temperature adjustment, power switching and automatic dimming. The function pattern 151 can be realized by such as a touch switch, a touch screen or an ordinary button, and the invention is not limited thereto.

Moreover, the brightness of illumination device 100 can have multi-stage adjustment, such as 15-stage adjustment, to meet various brightness requirements. Also, the color temperature of the illumination device 100 can have a wider range of adjustment, for example, from warm color temperature 2700K to cold color temperature 6500K. According to some embodiments, the color temperature also can have multi-stage adjustment, such as 2700K, 4000 K, and 6500K. Through multi-stage adjustment, desired color temperature can be achieved and various requirements of color temperature can be met.

Additionally, the illumination device 100 may further include a light sensor (not illustrated) disposed on the lampshade 110. The light sensor senses an ambient brightness of the illumination device 100 when the user triggers the function pattern 151 corresponding to the automatic dimming function. The light sensor can further compare the ambient brightness with a pre-determined brightness. If the ambient brightness and the pre-determined brightness are different or the difference between the ambient brightness and the pre-determined brightness exceeds a pre-determined value, then the brightness is calibrated according to the difference value. The pre-determined value can be set by designers or can be defined by the user according to actual needs. Specifically, if it is determined by the light sensor that the current ambient brightness is too bright, then the brightness of the illumination device 100 is dimmed. Conversely, if it is determined by the light sensor that the current ambient brightness is too dark, then the brightness of the illumination device 100 is filled. Thus, the light can be automatically dimmed or filled.

Besides, when the user triggers the function pattern 151 corresponding to the automatic dimming function, the light sensor can further sense an ambient color temperature of the illumination device 100 (such as the color temperature of the desktop of the user), and automatically adjust the color temperature of the illumination device 100 according to the sensed color temperature to meet a pre-determined color temperature. The pre-determined color temperature can be set by the designers or can be defined by the user according to actual needs. For example, the pre-determined color temperature is preferably designed as 4000K. Experimental results show that 4000K is the color temperature that best matches screen reading. According to some embodiments, the light sensor for sensing brightness and the light sensor for sensing color temperature can be different sensors. Specific design of the light sensors is up to the designers' discernment based on actual needs, and the present invention is not limited thereto.

The illumination device 100 according to an embodiment of the present invention can be electrically connected to the electronic device 200. The illumination device 100 can, in response to a control command of an application program of the electronic device 200, control the on/off state of the light source 130, the luminous intensity or the color temperature of the illuminating light of the light source 130. The illumination device 100 can be electrically connected to host 220 through a USB interface, such that the host 220 can provide a power to turn on the illumination device 100. Besides, the illumination device 100 can be powered by any plug or any power supply device with an USB interface. Detailed implementation depends on actual needs, and the present invention is not limited thereto. Specifically, the user can execute a control command equivalent to the function corresponding to one of the function patterns 151 of the user interface 150 through an application program installed on the electronic device 200. Then, the illumination device 100, in response to the control command, can turn on/off the light source 130, increase/reduce the luminous intensity of the illuminating light B1 emitted from the light source 130 (the luminous intensity corresponds to the brightness of the illumination device 100; the higher the luminous intensity of the illuminating light B1, the higher the brightness of the illumination device 100, and vice versa), and adjust the color temperature of the illuminating light B1 emitted from the light source 130 (warmer color temperature or cooler color temperature), or execute the said automatic dimming function. That is, the illumination device 100 according to an embodiment of the present invention can be linked to an application program installed on the electronic device 200, such that the user does not need to manually touch the user interface 151. Instead, the user can adjust various lighting parameters of the illumination device 100 through the application program installed on the electronic device 200, thereby greatly increasing the efficiency and convenience of use. Moreover, when the illumination device 100 is turned on, the illumination device 100 can maintain all lighting parameters set by the user in previous use. That is, the illumination device 100 can remember previous settings. Thus, when the illumination device 100 is used in an environment which is the same as the previous one, the user does not need to re-set various lighting parameters, indeed increasing convenience of use.

To summarize, according to an embodiment of the present invention, an illumination device for an electronic device is provided. The electronic device has a screen and a host, wherein a first lateral side of the screen is pivotally connected to the host having a keyboard surface. The illumination device includes a lampshade, a clamping portion and a light source. The clamping portion is connected to the lampshade and clamps the illumination device on a second lateral side of the screen, wherein the second lateral side is an opposite side of the first lateral side. The light source is disposed in the lampshade and provides an illuminating light. A fixed angle is formed between an optical axis of the illuminating light and a keyboard surface of the host. Thus, when the illuminating light emitted from the light source irradiates on the keyboard surface, the generated reflective light is non-dazzling and will not enter they user's eyes, such that the light does not irradiate on the display screen or the keyboard and the generated reflective light does not blind the user's eyes. Furthermore, the illuminating light mainly irradiates on a region outside the keyboard surface and focuses on an ideal illumination region, such that undesired regions are avoided and an optimal experience of use can be achieved.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An illumination device for an electronic device having a screen and a host, wherein a first lateral side of the screen is pivotally connected to the host, the host has a keyboard surface, the illumination device comprising:

a lampshade having an illuminating surface;

a clamping portion connected to the lampshade and clamping the illumination device on a second lateral side of the screen, wherein the second lateral side is an opposite side of the first lateral side;

a light source disposed in the lampshade and providing an illuminating light having an optical axis, wherein a fixed angle is formed between the optical axis of the illuminating light and the keyboard surface; and a rotation portion connecting the clamping portion and the lampshade, wherein when an angle between the screen and the host changes, the rotation portion allows an angle between the lampshade and the clamping portion to be adjusted, such that when the illuminating surface is substantially parallel to the keyboard surface, the fixed angle between the optical axis and the keyboard surface can be maintained.

2. The illumination device according to claim 1, wherein the fixed angle is between 25°~35°.

3. The illumination device according to claim 1, wherein the rotation portion allows the angle between the lampshade and the clamping portion to be adjusted by 0°~52°, and when the illuminating surface is substantially parallel to the keyboard surface, the illuminating light mainly irradiates on a region outside the keyboard surface.

4. The illumination device according to claim 1, wherein the angle between the screen and the host changes between 90°~125°.

5. The illumination device according to claim 1, wherein the lampshade has a first side portion, a second side portion and a bottom portion, the light source is disposed on the first side portion, and a length of the second side portion is larger than or equivalent to a length of the first side portion.

6. The illumination device according to claim 1, wherein the lampshade has a first side portion, a second side portion and a bottom portion, a connection line connecting an edge of the first side portion with an edge of the second side portion is substantially parallel to the keyboard surface.

7. The illumination device according to claim 1, further comprising:

an inclination sensor disposed in the lampshade and sensing whether the illuminating surface is substantially parallel to the keyboard surface.

8. The illumination device according to claim 7, wherein the inclination sensor is a leveling instrument, the lampshade further comprises an indicator lamp, and the indicator lamp is turned on when the illuminating surface is substantially parallel to the keyboard surface.

9. The illumination device according to claim 7, wherein the light source flashes for several times when the illuminating surface is substantially parallel to the keyboard surface.

10. The illumination device according to claim 1, further comprising:

an optical lens disposed in the lampshade and changing a beam angle of the illuminating light.

11. The illumination device according to claim 10, wherein the optical lens is a total internal reflection (TIR) lens with strip shape.

12. The illumination device according to claim 10, wherein the beam angle of the illuminating light changes between 20°~30°.

13. The illumination device according to claim 1, further comprising:

an user interface disposed on the lampshade for providing at least one function pattern, the least one function pattern corresponding to one of the functions including brightness adjustment, color temperature adjustment, power switching and automatic dimming.

14. The illumination device according to claim 1, further comprising:

a light sensor disposed on the lampshade and sensing an ambient brightness.

15. The illumination device according to claim 1, wherein the illumination device is electrically connected to the electronic device, an application program of the electronic device controls an on/off state of the light source, a luminous intensity or a color temperature of the illuminating light of the light source, or execute an automatic dimming function.

* * * * *